US008322178B2

(12) United States Patent
Kawai et al.

(10) Patent No.: US 8,322,178 B2
(45) Date of Patent: Dec. 4, 2012

(54) METHOD FOR PERFORMING TEMPER ROLLING ON STEEL STRIP AND METHOD FOR MANUFACTURING HIGH TENSILE-STRENGTH COLD ROLLED STEEL SHEET

(75) Inventors: Takamasa Kawai, Tokyo (JP); Yukio Kimura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 780 days.

(21) Appl. No.: 12/519,468

(22) PCT Filed: Dec. 6, 2007

(86) PCT No.: PCT/JP2007/073983

§ 371 (c)(1),
(2), (4) Date: Jun. 16, 2009

(87) PCT Pub. No.: WO2008/075603

PCT Pub. Date: Jun. 26, 2008

(65) Prior Publication Data

US 2010/0024513 A1 Feb. 4, 2010

(30) Foreign Application Priority Data

Dec. 18, 2006 (JP) ..... 2006-339603
Jun. 22, 2007 (JP) ..... 2007-164548

(51) Int. Cl.
*B21B 1/00* (2006.01)
*B21B 39/20* (2006.01)
*B44B 5/00* (2006.01)

(52) U.S. Cl. ..... 72/187; 72/197; 72/252.5; 72/365.2

(58) Field of Classification Search ..... 72/187, 72/197, 198, 252.5, 365.2, 366.2
See application file for complete search history.

(56) References Cited

U.S. PATENT DOCUMENTS 4,798,722 A * 1/1989 Edman et al. ..... 424/70.5
4,978,583 A * 12/1990 Wakui et al. ..... 72/47
(Continued)

FOREIGN PATENT DOCUMENTS

JP 5-154505 A 6/1993
(Continued)

OTHER PUBLICATIONS

Japanese Search Report dated Mar. 18, 2008, application No. PCT/JP2007/073983.

*Primary Examiner* — David B Jones
(74) *Attorney, Agent, or Firm* — RatnerPrestia

(57) ABSTRACT

Temper rolling at a total elongation percentage of 0.1% or more is performed on a steel strip using a temper rolling mill in which at least one roll stand having high roughness work rolls, the center-line averaged roughness Ra of which being in the range of 3.0 to 10.0 μm, is provided, or at least one roll stand having bright rolls is further provided downstream of the above roll stand, and as a result, a predetermined elongation percentage, flatness, and center-line averaged roughness can be imparted even to a steel strip having a yield strength of 340 MPa or more at a rolling load approximately equivalent to that for a mild steel without using a large facility and complicated control. In particular, a high tensile-strength cold rolled steel sheet having an Ra of 0.5 to 3.0 μm and superior die galling resistance is obtained.

16 Claims, 6 Drawing Sheets

U.S. PATENT DOCUMENTS

| | | | | |
|---|---|---|---|---|
| 5,789,066 | A * | 8/1998 | De Mare et al. | 29/283.5 |
| 5,799,527 | A * | 9/1998 | Kenmochi et al. | 72/252.5 |
| 5,857,373 | A * | 1/1999 | De Mare et al. | 72/252.5 |
| 6,138,490 | A * | 10/2000 | Shannon | 72/365.2 |
| 6,153,316 | A * | 11/2000 | Shannon | 72/700 |
| 6,230,534 | B1 * | 5/2001 | Sato et al. | 72/252.5 |
| 7,296,517 | B2 * | 11/2007 | Nishino et al. | 72/252.5 |
| 7,516,637 | B2 * | 4/2009 | Scamans et al. | 72/187 |

FOREIGN PATENT DOCUMENTS

| | | |
|---|---|---|
| JP | 10-005809 | 1/1998 |
| JP | 2006-007233 | 1/2006 |
| JP | 2006-142343 A | 6/2006 |
| WO | WO 95/07774 | 3/1995 |

* cited by examiner

METHOD FOR PERFORMING TEMPER ROLLING ON STEEL STRIP AND METHOD FOR MANUFACTURING HIGH TENSILE-STRENGTH COLD ROLLED STEEL SHEET

This application is a U.S. National Phase Application of PCT International Application No. PCT/JP2007/073983, filed Dec. 6, 2007, which claims priority to Japanese Patent Application No. 2006-339603, filed Dec. 18, 2006, and Japanese Patent Application No. 2007-164548, filed Jun. 22, 2007, the contents of such applications being incorporated by reference herein in their entirety.

TECHNICAL FIELD

The present invention relates to a method for performing temper rolling on a steel strip and a method for manufacturing a high tensile-strength cold rolled steel sheet.

BACKGROUND

Temper rolling is performed on a steel strip by skinpass rolling, for example, at a reduction of 1% or less using a temper rolling mill. By performing this temper rolling, a steel strip is equally elongated, and the shape thereof is corrected, so that a predetermined flatness can be obtained. In addition, by the temper rolling, for example, mechanical properties, such as the yield elongation, the tensile strength, and the elongation, and surface roughness of a steel strip can also be improved.

In recent years, concomitant with development of high-value added steel strips, a steel strip made of hard steel, such as so-called high tensile-strength steel or high-carbon steel, has been increasingly in demand. When a steel strip made of hard steel as described above is processed by temper rolling using a temper rolling mill, a high rolling load (rolling burden) is required to impart a necessary elongation percentage to the steel strip. In particular, it has been difficult to impart an elongation percentage to thin hard steel having a thickness of 1.0 mm or less.

In addition, among high tensile-strength steel sheets, a steel sheet manufactured by continuous annealing including a quenching treatment and a tempering treatment has a problem in that the surface shape thereof is deformed, during the quenching treatment, by thermal stress and/or phase transformation of steel microstructure, so that a shape defect is liable to occur. Even when a steel-sheet surface is planarized by cold rolling before annealing, it is difficult to overcome this shape defect of a steel sheet. Accordingly, it is desirable to correct the shape of a steel sheet by temper rolling after annealing. However, in the case of a high tensile strength steel sheet having a tensile strength of 980 MPa or more, when an elongation percentage required for shape correction is imparted thereto, a flow stress is high, and hence a very high rolling load is required.

In particular, for a high tensile-strength steel that requires shape correction, a higher rolling load is required, and hence it is sometime difficult for an existing temper rolling mill to perform the shape correction. Accordingly, the shape correction is actually performed in such a way that after temper rolling is performed, a shape-correction step is additionally performed. However, in this case, concomitant with an increase in number of steps, problems, such as an increase in manufacturing cost and a longer delivery time, occur.

Furthermore, in the situation described above, hard steel having properties that require higher facility performance than that of an existing facility has been introduced, and the number of cases in which correction cannot be performed by an existing temper rolling mill starts to increase; hence, the countermeasures therefor have been strongly desired.

For example, as one of the countermeasures for the above problems, a method may be mentioned in which temper rolling is performed while a high tensile force is applied to a steel strip. By this method, although it is possible to impart a sufficient elongation percentage at a low rolling load, since bridle rolls must be additionally provided, or the number of which must be increased (for example, the number of rolls is increased from two to three) in order to ensure a necessary high tensile force, a large installation space is required, and facility cost is also increased.

As another countermeasure, although a method may also be mentioned in which a temper rolling mill that can impart a high load is manufactured, since a housing capable of withstanding a correction load is required, a large installation space is also required, and facility cost is increased.

In addition, although a method may also be mentioned in which the diameter of each work roll is decreased, since the deflection of the work roll has a serious influence on a steel strip shape, a highly-accurate shape control system in consideration of this influence must be provided. Furthermore, due to a decrease in withstand load of the roll caused by the decrease in diameter thereof, the rolls may even be broken in some cases.

In order to overcome the problems described above, in Japanese Unexamined Patent Application Publication No. 10-5809 (Patent Document 1), a technique has been disclosed in which by performing temper rolling at a predetermined strain rate in a predetermined warm temperature region, a decrease in rolling load is realized, and temper rolling can be performed on hard steel.

In addition, as another problem concomitant with the increase in strength of a steel strip, since a load applied during press forming increases, and a stress between a press die and a steel strip becomes very high, die galling is disadvantageously liable to occur.

In order to improve die galling resistance, although it is believed that the control of surface roughness of a steel sheet may have an effect to a certain extent, the surface roughness that can be imparted to a hard steel sheet by conventional temper rolling is very limited, and another method for imparting surface roughness has also been proposed. For example, in Japanese Unexamined Patent Application Publication No. 2006-7233 (Patent Document 2), rolling is performed using dull rolls provided at a final stand of cold rolling, and the surface roughness is formed in the surface of a steel strip.

However, in the method for performing temper rolling on a steel strip disclosed in Japanese Unexamined Patent Application Publication No. 10-5809 (Patent Document 1), the temperature of every steel strip to be processed by temper rolling must be controlled, and the control is not only complicated, but an apparatus and a system used for the temperature control are also required. In addition, in order to perform warm rolling, when the difference in temperature is generated in a width direction of a steel strip, the flow stress varies in the width direction, and the shape of the steel strip after rolling may be influenced thereby in some cases. Furthermore, when the flatness is significantly improved in the state in which the difference in temperature is present, after the temperature is decreased to room temperature, the difference in shape is generated due to the difference in thermal shrinkage caused by the difference in temperature. In addition, since a warm steel strip is rolled, as a rolling length to be continuously rolled is increased, a work roll is thermally expanded, and as a result, it is disadvantageously difficult to control the shape of a steel sheet.

In addition, in the method for manufacturing a steel strip disclosed in Japanese Unexamined Patent Application Publication No. 2006-7233 (Patent Document 2), work rolls having a center-line averaged roughness Ra of 2.0 μm or more are used at a final stand of a tandem cold rolling mill which can impart a high tensile force to a steel strip. However, when cold rolling is performed using work rolls having an Ra of 2.0 μm or more, the friction coefficient increases, and as a result, the rolling load unfavorably increases. Furthermore, according to this method, a reduction amount of 8 μm or more is imparted to a steel strip: however, when the reduction is performed at a high stress by the high roughness work rolls as described above, sliding occurs between the steel strip and the work rolls while protuberances thereof stick in the steel strip, and hence, a wear volume of the work roll surface increases. When the center-line averaged roughness Ra is decreased by the wear, a sufficient surface roughness transcription cannot be performed, and as a result, roll exchange must be frequently performed.

SUMMARY

The present invention provides a method for performing temper rolling on a steel strip, which can impart a predetermined elongation percentage, flatness, and center-line average roughness even to a steel strip having, for example, a yield strength of 340 MPa or more at a rolling load approximately equivalent to that for mild steel without using a large facility and complicated control. The present invention also provides a method for manufacturing a high tensile-strength cold rolled steel sheet, in particular, a high tensile-strength cold rolled steel sheet having superior die galling resistance, which does not place a burden on temper rolling and which does not require any additional steps.

The high tensile-strength cold rolled steel sheet includes a hard steel sheet having a yield strength of 340 MPa or more and also includes high-carbon steel as well as a narrowly defined high tensile-strength cold rolled steel sheet.

In one exemplary embodiment of the present invention, as the rolling load described above, when temper rolling is performed to impart an elongation percentage of 0.1%, a rolling load per unit width of approximately 4.0 kN/mm is set as a target, and for a super hard steel having a yield strength of 980 MPa or more, the rolling load per unit width is suppressed to approximately 8.0 kN/mm, so that the method can be actually performed using an existing facility. When temper rolling is performed to impart an elongation percentage of 0.2% in order to obtain a higher shape correction effect, a rolling load per unit width of approximately 5.0 kN/mm is set as a target, and even for a super hard steel having a yield strength of 980 MPa or more, a rolling load per unit width of approximately 10.0 kN/mm is set as a target.

The inventors of the present invention carried out research focusing on the center-line averaged roughness of a work roll as a method for decreasing a temper rolling load. In FIG. 1, the relationships between the average roughness (center-line averaged roughness) Ra (horizontal axis) of a work roll surface and the rolling load (vertical axis) obtained when rolling is performed at the same reduction is provided. As shown by the dotted line in FIG. 1, by normal rolling (tandem cold rolling mill) performed, for example, at a reduction of approximately 5% to 50%, as the surface roughness of the work roll surface is increased, the rolling load increases with respect to the same reduction. The reason for this is that since as the average roughness of the work roll surface is increased, since sliding between a steel strip and the roll is suppressed, and the friction coefficient increases, deformation of the steel strip is suppressed during rolling, and the load increases. Hence, in order to maintain the rolling load at low level, bright rolls having a low average roughness are optionally used.

However, through intensive research carried out by the inventors of the present invention, it was newly found that when temper rolling is performed at a reduction of 1% or less, as shown by the solid line in FIG. 1, the load conversely decreases when rolling is performed using a roll having a high average roughness. The reason for this is believed to be that when irregularities of a roll are transferred to the surface of a steel strip, a phenomenon (hereinafter refereed as a "transcription elongation effect") in which a portion of the steel strip excluded thereby generates elongation (that is, corresponding to the volume indented by roll protuberances) becomes significant.

Through further intensive research carried out by the inventors of the present invention, it was found that when the average surface roughness Ra is up to approximately 2 μm, irregularities of a roll stick in a steel sheet, and adjacent irregularities interfere with each other when plastic deformation occurs, so that a sufficient transcription elongation effect cannot be obtained. Accordingly, in order to obtain the transcription elongation effect, it was found that the average roughness Ra of a work roll surface can be beneficially set to 3.0 μm or more. In FIG. 1, the left-side dotted-line frame is a region having an Ra of 0.2 μm or less which approximately corresponds to that of a surface of a general bright roll, the central dotted-line frame is a region having an Ra of 1 to 2 μm which corresponds to that of a roll surface treated by conventional dull finish, and the right-side dotted-line frame is a region having an Ra of 3 μm or more which corresponds to that of a surface of a high roughness roll. In addition, between the dotted line indicating the normal rolling and the solid line indicating the temper rolling, although the rolling load is different from each other, in FIG. 1, the rolling loads thereof are set equivalent to each other in a low roughness region.

In addition, under temper rolling conditions in which a low elongation percentage of approximately 0.1% to 0.2% is imparted, when the average roughness Ra of a work roll surface is set to more than 4.0 μm, the space between adjacent protuberances sufficiently increases, and as a result, interference in plastic deformation hardly occurs. Accordingly, in order to decrease the load by effectively using the transcription elongation effect, the average roughness Ra of a work roll surface is preferably set to more than 4.0 μm. Since an increase in roughness is effective even when the elongation percentage is 0.2% or more, Ra is preferably set to 4.0 μm or more.

However, it has been very difficult from an industrial point of view to stably perform a high average-roughness treatment on a work roll, and it is also not preferable from the roll life point of view. Hence, the average roughness Ra of a work roll surface is preferably set to 10.0 μm or less.

In addition, by a bumping effect, that is, by material transfer in the vicinity of a dent generated by local plastic deformation, a steel strip processed by temper rolling using a roll having a high center-line averaged roughness as described above is placed in a new stress-balance state in which the top and the bottom surfaces are equally and plastically stabilized, and as a result, by a phenomenon in which the flatness is improved, the surface shape is significantly improved. In particular, a sheet shape represented by the degree of steepness or the like has a value that approximately indicates a flat state.

Furthermore, it was also found that as the difference in average roughness of a steel strip surface before and after temper rolling is increased, that is, as the average roughness is increased, the shape correction effect is more significant.

Exemplary embodiments of the present invention have one or more of the following features.

[1] A method for performing temper rolling on a steel strip is provided which uses a temper rolling mill including at least one roll stand having work rolls, the center-line averaged roughness Ra of which being in the range of 3.0 to 10.0 μm, and which comprises performing temper rolling at an elongation percentage of 0.1% or more on a steel strip having a yield strength of 340 MPa or more.

[2] A method for performing temper rolling on a steel strip is provided which uses a temper rolling mill including: at least one roll stand (hereinafter referred to as a "first roll stand") having work rolls, the center-line averaged roughness Ra of which being in the range of 3.0 to 10.0 μm; and at least one roll stand (hereinafter referred to as a "second roll stand") which is provided downstream of the roll stand and which has bright-finished work rolls, the method comprising performing temper rolling at an elongation percentage of 0.1% or more on a steel strip having a yield strength of 340 MPa or more.

[3] According to the above [1] or [2], in the method for performing temper rolling on a steel strip, the temper rolling is performed so that the average roughness Ra of a steel strip surface after the temper rolling is in the range of 0.5 to 3.0 μm.

[4] According to the above [2], in the method for performing temper rolling on a steel strip, after a total elongation percentage of 0.1% or more is imparted by the roll stand (the first roll stand) having work rolls, the center-line averaged roughness of which being 3.0 to 10 μm, the temper rolling is performed by the roll stand (the second roll stand) having bright-finished work rolls so that the average roughness Ra of a steel strip surface is in the range of 0.5 to 3.0 μm.

[5] According to one of the above [1] to [4], in the method for performing temper rolling on a steel strip, the temper rolling mill is provided downstream of an outlet side of an annealing furnace of a continuous annealing facility and is one constituent thereof, and the steel strip having a yield strength of 340 MPa or more is a high tensile-strength cold rolled steel strip having a tensile strength of 980 MPa or more and manufactured by continuous annealing including a quenching treatment and a tempering treatment.

[6] According to the above [5], in the method for performing temper rolling on a steel strip, the high tensile-strength cold rolled steel strip having a tensile strength of 980 MPa or more is a high tensile-strength cold rolled steel strip obtained by performing the continuous annealing including a quenching treatment and a tempering treatment on a cold rolled steel strip which is processed by cold rolling so that the average roughness Ra of a steel strip surface is controlled to be 0.3 μm or less.

[7] According to one of the above [1] to [6], in the method for performing temper rolling on a steel strip, temper rolling at an elongation percentage of 0.2% or more is performed using the temper rolling mill.

[8] A method for manufacturing a high tensile-strength cold rolled steel sheet is provided which comprises performing temper rolling on a steel strip having a yield strength of 340 MPa or more by the method for performing temper rolling on a steel strip according to one of the above [1] to [7].

In addition, the bright-finished work rolls described above are work rolls each having a roll surface smoothed by polishing or the like so that the average roughness Ra of a surface which is at least in contact with a steel strip is 0.3 μm or less (hereinafter, the term "bright roll" has the same meaning as described above, unless otherwise stated).

REFERENCE NUMERALS

Figure 1:
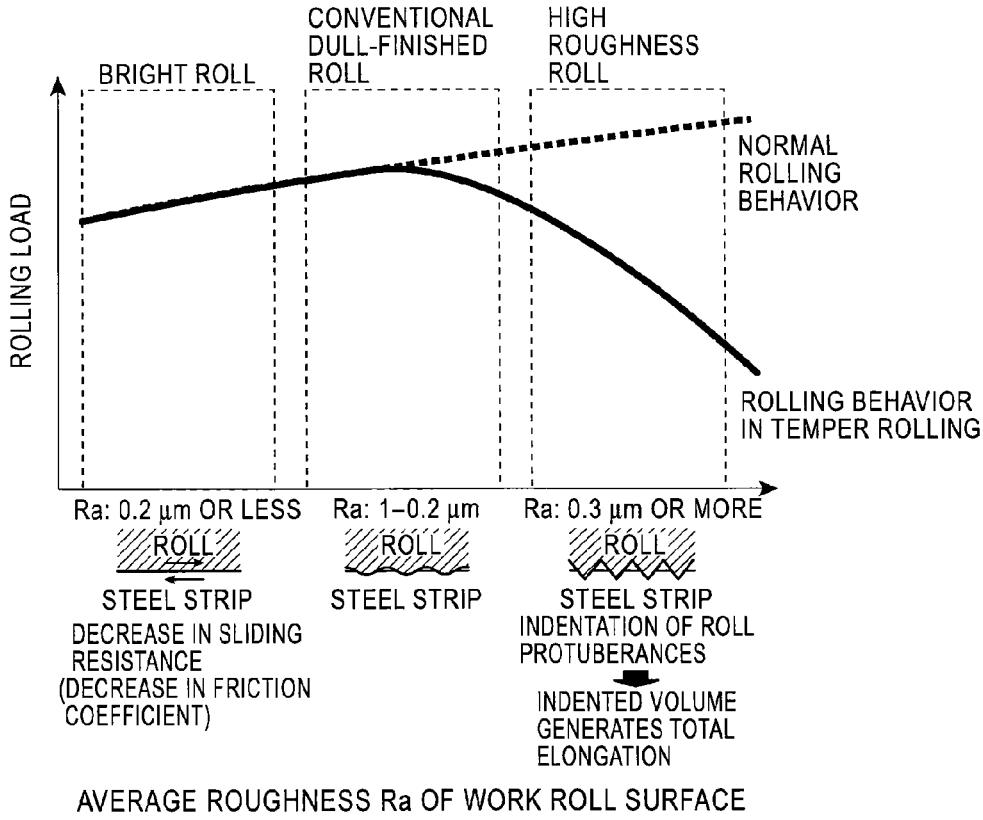
FIG. 1 is a view showing the relationships between the average roughness Ra of a work roll surface (horizontal axis) and the rolling load (vertical axis), which are obtained by normal rolling (dotted line) and temper rolling (solid line) performed at the same reduction.

1 steel strip
2 high roughness roll
3, 5 roll stand
4 bright roll
6 annealing furnace
7 temper rolling mill
8 tandem cold rolling mill
9 final stand
10 sheet traveling direction
11 back-up roll
12 continuous annealing facility
13 coil
14 looper
15 tension application device

DETAILED DESCRIPTION

Hereinafter, embodiments of the present invention will be described by way of example.

A method for performing temper rolling on a steel strip according to one exemplary embodiment of the present invention is to perform temper rolling at an elongation percentage of 0.1% or more on a steel strip (a so-called high tensile-strength steel strip/steel sheet) having a yield strength of 340 MPa or more using a temper rolling mill which includes at least one roll stand having work rolls, the center-line averaged roughness of which being in the range of 3.0 to 10.0 μm. In order to obtain a higher shape correction effect, an elongation percentage of 0.2% or more is preferably imparted. Hence, to a material called a shape-strict material which requires strict shape flatness, an elongation percentage of 0.2% or more is preferably imparted.

In addition, the upper limit of the yield strength of a steel strip to which the present invention can be applied is not particularly limited. At least it has been confirmed that the present invention can be applied to a steel strip having a tensile strength of approximately 1,470 MPa (a yield strength of approximately 1,300 MPa); however, it is believed that a steel strip having a yield strength of approximately 1,500 MPa may not cause any problems.

The roughness can be imparted to the work roll surface by performing dull finishing thereon. As the dull finishing method, for example, a shot blasting method, an electrical discharge dull finishing method, a laser dull finishing method, or an electron beam dull finishing method may be used. Furthermore, as an anti-wear countermeasure, chromium plating may be performed on a roll treated by dull finishing in some cases. However, when the above Ra can be controlled within a targeted value, the finishing method, the type of subsequent surface treatment, and the conditions thereof are not particularly limited.

In this embodiment, the above average roughness Ra is defined as follows in accordance with JIS B0601 of Japan Industrial Standard.

The surface is measured, and only a reference length (l) is extracted from an obtained roughness curve along the direction of its average line. Then, the x axis is set in the direction of the average line of the extracted portion, the y axis is set in a direction of a longitudinal magnification thereof, and the roughness curve is represented by y=f(x). The value obtained by the following formula (1) is expressed by micrometer (μm) and is defined as Ra.

$$Ra = \frac{1}{l}\int_0^l \{f(x)\}\,dx \tag{1}$$

As the value of the center-line averaged roughness Ra of the work roll, the value obtained at a representative position of the work roll surface using the above formula (1) may be used, or the average of Ra values measured at a plurality of positions of the work roll surface may be used. When the average value obtained from values measured at a plurality of positions is used, for example, the average of 12 values may be used which are obtained, at a portion of the work roll at least in contact with a steel strip, from 4 points along the circumferential direction with regular intervals of 90° each located at 3 points at the center and the two sides of the work roll in the width direction. In addition, in general, a reference length of 4 mm and a cut-off value of 0.8 mm are used, and these conditions are also used in the present invention; however, when the JIS particularly specifies the conditions, the specified conditions are preferentially used.

In the following description, a work roll treated by dull finishing so that the center-line averaged roughness Ra is set in the range of 3.0 to 10.0 μm is called a "high roughness roll".

(Control Principle of Transcription Elongation Effect)

When the above high roughness roll is used, by the transcription elongation effect described above, temper rolling can be performed on a steel strip composed of hard steel, such as high tensile-strength steel or high-carbon steel, at a rolling load approximately equivalent to that for mild steel. In addition, in order to obtain a sufficient load decreasing effect by a more significant transcription elongation effect, the center-line averaged roughness Ra is preferably set to more than 4.0 μm. Furthermore, since the influence of indentation by transfer of roll-surface irregularities relatively increases as the thickness of a steel strip is decreased, the transcription elongation effect by a high roughness roll is increased, and hence a significant rolling load decreasing effect can be expected. Hereinafter, the relationship between the average roughness Ra of a work roll surface and the transcription elongation effect is shown which is obtained by various investigations through experiments and numerical analyses.

A transfer depth by the indentation of irregularities of a work roll surface has a close relationship with a contact stress, and it was found by numerical analysis investigation that the maximum transfer depth is proportional to the power of two third of the maximum contact stress. In addition, it was also found that the amount of volume decrease in the surface by the indentation is proportional to the power of three of the transfer depth, the average roughness of a steel strip surface is proportional to the amount of volume decrease, and hence the center-line averaged roughness is proportional to the power of two of the maximum contact stress. In addition, it was also observed that the center-line averaged roughness of a steel strip is inversely proportional to the power of two of the yield strength. That is, the average roughness of a steel strip surface has the relationship represented by the following formula (2) with the above factors.

$$\text{Center-line averaged roughness of steel strip} \propto \left(\frac{\text{Maximum contact stress}}{\text{Yield strength}}\right)^2 \quad (2)$$

In the temper rolling, it is regarded that the maximum contact stress has the relationship with a work roll diameter and a unit-width load as shown by the following formula (3). The reason for this is believed that the contact length is proportional to the power of one half of the work roll diameter and the maximum contact stress is inversely proportional to the contact length.

$$\text{Maximum contact stress} \propto \left(\frac{\text{Unit-width load}}{\text{Work roll diameter}}\right)^{0.5} \quad (3)$$

Furthermore, it is also found through investigation that the average roughness of a steel strip surface is proportional to the center-line averaged roughness of a roll, and the average roughness of a steel strip surface is represented by the following formula (4).

$$\text{Center-line averaged roughness of steel strip surface} = \alpha \times \left(\frac{\sqrt{\frac{\text{Unit-width load}}{\text{Work roll diameter}}}}{\text{Yield strength}}\right)^2 \times \text{Average roughness of roll surface} \quad (4)$$

In the above formula, $\alpha$ is a factor determined by temper rolling conditions and the like.

According to further investigation, the transcription elongation effect can be represented by the following formula (5) using the average roughness of a steel strip surface which is obtained by the above formula.

$$\text{Transcription elongation effect} = \beta \times \frac{\text{Average roughness of still strip surface}}{\text{Thickness of steel strip}} \quad (5)$$

In the above formula, $\beta$ is a factor determined by surface conditions of a steel strip and the like. The above formula (5) indicates that transfer of the average roughness of a work roll surface to a steel strip surface has a linear relationship with the transcription elongation effect. In addition, since the transcription elongation effect is decreased as the thickness is increased, contribution to the elongation percentage is also decreased.

(Average Roughness of Steel Strip Surface)

In addition, the average roughness of a steel strip surface has a significant influence on die galling in pressing. The reason for this is believed that as the average roughness of a steel strip surface is increased, oil retention properties of a press oil are enhanced, and as a result, contact resistance between a die and a steel strip decreases.

When the average roughness Ra of a steel strip surface after temper rolling is set in the range of 0.5 to 3.0 μm, a steel strip having superior die galling resistance can be obtained without degrading the appearance, paintability, and the like of a steel strip. In addition, in order to further improve the die galling resistance, the average roughness Ra of the steel strip surface after temper rolling is preferably set in the range of 1.5 to 3.0 μm.

It has been believed that by conventional temper rolling, high roughness as described above is difficult to be imparted to hard steel. However, by using the above investigation results, when temper rolling is performed under rolling conditions which are set so that the elongation percentage of a steel strip and the center-line averaged roughness are controlled in predetermined ranges, a steel strip (cold rolled steel sheet) having superior flatness and die galling resistance can be manufactured.

(Addition of Bright-Roll Rolling)

When the above transcription elongation effect is used, temper rolling can be performed on a hard rolling material, such as hard steel including high-tensile strength steel having a yield strength of 340 MPa or more or high-carbon steel, to which the elongation percentage is difficult to be imparted by decreasing the thickness through rolling. When a predetermined elongation percentage is imparted only by the transcription elongation effect, the average roughness of a steel strip surface after temper rolling may be determined by the above formula (5). When the average roughness is determined as described above, although the case in which the average roughness of a steel strip surface exceeds a targeted value may occur, in this case, the average roughness of a steel strip surface may be decreased in a subsequent step, in particular, at a downstream stand provided in a temper rolling mill.

Figure 2:
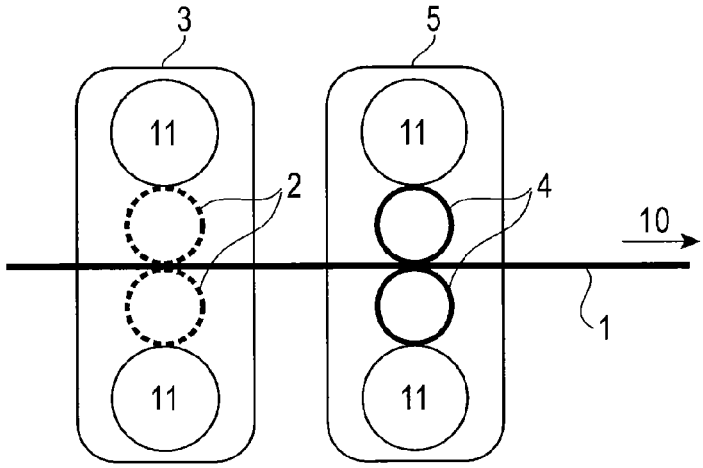
FIG. 2 is a schematic structural view showing one example of a temper rolling mill used for a method for performing temper rolling on a steel strip according to aspects of the present invention.

FIG. 2 is a schematic structural view showing one example of a temper rolling mill used for the method for performing temper rolling on a steel strip of the present invention. The temper rolling mill shown in FIG. 2 includes a roll stand 3 having high roughness rolls 2 at an upstream side with respect to a sheet traveling direction 10 of a steel strip 1 and a roll stand 5 having bright-finished work rolls 4 (hereinafter referred to as "bright rolls 4") at a downstream side of the roll stand 3. In FIG. 2, the roll stands 3 and 5 are each shown as a four-stage type stand (that is, back-up rolls 11 which press the work rolls 4 are provided for the respective work rolls 4 which directly compress a steel sheet); however, the present invention is not limited to the case of a four-stage type. That is, a temper rolling effect similar to that described above can also be obtained using a two-stage type, a six-stage type, or a cluster type roll stand.

In addition, a temper rolling mill to which the present invention is applied may have at least one roll stand having the high roughness rolls 2, and it is not limited to increase the number of stands in accordance with necessity and an available installation space. In addition, the roll stand 5 having the bright rolls 4 may be omitted, and it is not particularly limited to further increase the number of stands in accordance with necessity and an available installation space.

However, in the temper rolling mill, it is preferably avoided to actually change the order of the bright rolls and the high roughness rolls and to actually add rolls having different roughness (such as general dull rolls).

Figure 3:
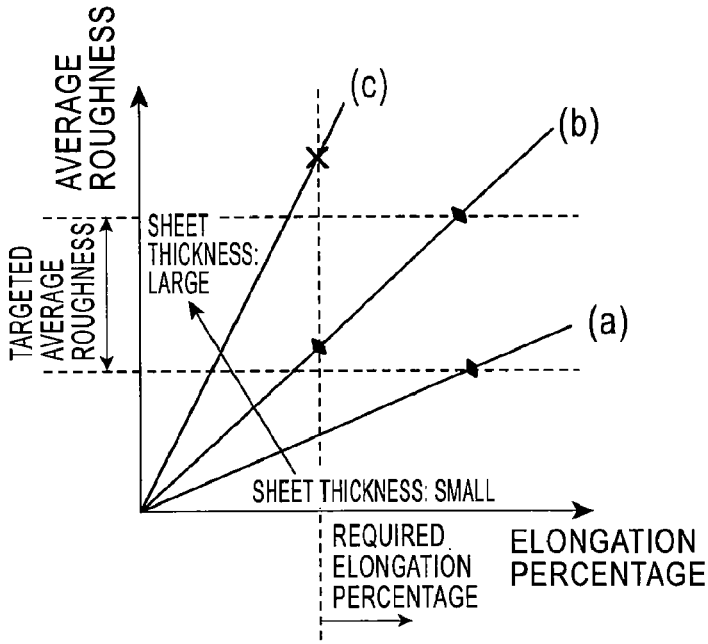
FIG. 3 is a view showing the relationship at each sheet thickness between the elongation percentage (horizontal axis) and the average roughness (vertical axis) of a steel strip surface, which is obtained when temper rolling is performed by high roughness rolls using a temper rolling mill according to aspects of the present invention.

In FIG. 3, the relationship between the elongation percentage (horizontal axis) and the center-line averaged roughness (vertical axis) of a steel strip surface is shown which is obtained when temper rolling is performed by high roughness rolls using a temper rolling mill according to exemplary embodiments of the present invention. Since the elongation percentage has a linear relationship with the average roughness of a steel strip surface as represented by the above formula (5), when only the sheet thickness is changed, in accordance with the sheet thicknesses, linear lines (a), (b), and (c) shown in FIG. 3 are obtained. In this case, in terms of the sheet thickness, (a)<(b)<(c) is satisfied. In addition, the relationship shown in FIG. 3 is satisfied regardless of whether the number of rolling performed by the high roughness rolls is one or at least two (in this case, the elongation percentage is the total value).

In the figure, the region surrounded by the dotted lines is a targeted region of the elongation percentage and the average roughness. The target of the elongation percentage is primarily determined by a desired shape and desired mechanical properties of a steel sheet.

When the sheet thickness is not excessively large (for example, in the cases shown by (a) and (b) in FIG. 3), targeted conditions of the elongation percentage and the average roughness can be satisfied only by the temper rolling using the high roughness rolls. That is, in accordance with the lines (a) and (b), temper rolling may be performed using the high roughness rolls in a region represented by ♦ marks (black diamond shapes) and the solid lines.

For example, when the targeted region of the average roughness Ra of a steel strip surface is set in the range of 0.5 to 3.0 μm, and the elongation percentage is controlled by the formulas (4) and (5) in accordance with the average roughness of a work roll surface, a high-tensile strength steel strip having superior flatness and die galling resistance can be manufactured.

On the other hand, in the case in which the sheet thickness of a steel strip is large (for example, in the case shown by (c) in FIG. 3), when only a necessary minimum elongation percentage is imparted, the average roughness of a steel strip surface exceeds the targeted range. In this case, the average roughness of a steel strip surface may be decreased by a downstream-side stand provided in the temper rolling mill. As a method for decreasing the average roughness of a steel strip surface, at least one roll stand having bright rolls is preferably provided downstream of the roll stand having high roughness rolls.

For example, in order to manufacture a high-tensile strength steel strip having superior flatness and die galling resistance when the thickness thereof is large, the conditions of temper rolling performed by bright rolls may be set so that:

the average roughness of a steel strip surface imparted by the high roughness rolls can be decreased within a predetermined range (average roughness Ra: 0.5 to 3.0 μm), and an elongation percentage of 0.1% or more required for temper rolling (elongation percentage of 0.2% or more when a higher shape correction effect is aimed) can be ensured by the whole temper rolling mill (that is, the total of the elongation percentage imparted by the high roughness rolls and the elongation percentage imparted by the bright rolls).

In addition, whether the temper rolling performed by the bright rolls is necessary or not after the temper rolling performed by the high roughness rolls depends on the center-line averaged roughness Ra of the high roughness roll, the thickness of a steel strip, and the average roughness of a steel strip surface before temper rolling; hence, the relationships as shown in FIG. 3 are obtained beforehand under respective conditions, and the temper rolling conditions may be determined thereby. For example, in the case in which temper rolling is performed at an elongation percentage of 0.2% on a steel strip having an average roughness Ra of 0.5 μm before temper rolling by high roughness rolls having a center-line averaged roughness Ra of 6 μm, when the sheet thickness is less than 2 mm, an average roughness in a predetermined range can be obtained only by the high roughness rolls; however, when the sheet thickness is 2 mm or more, subsequent temper rolling using the bright rolls is preferably performed.

In order to respond to a wide sheet thickness range, it is preferable that at least one stand having bright rolls be provided, and whenever necessary, a stand having bright rolls (when a plurality of stands is provided, at least some thereof) may be placed in an open state (may be placed in a non-operation state).

(Usage as In-Line Mill)

In addition, the temper rolling mill may be a mill which is provided downstream of an outlet side of an annealing furnace of a continuous annealing facility and which performs in-line temper rolling on a steel strip processed by continuous annealing. That is, it is preferable that the temper rolling mill be incorporated in a continuous annealing facility as one constituent thereof and that a temper rolling step be incorporated in a continuous annealing process as one of steps sequentially performed therein.

Figure 4:
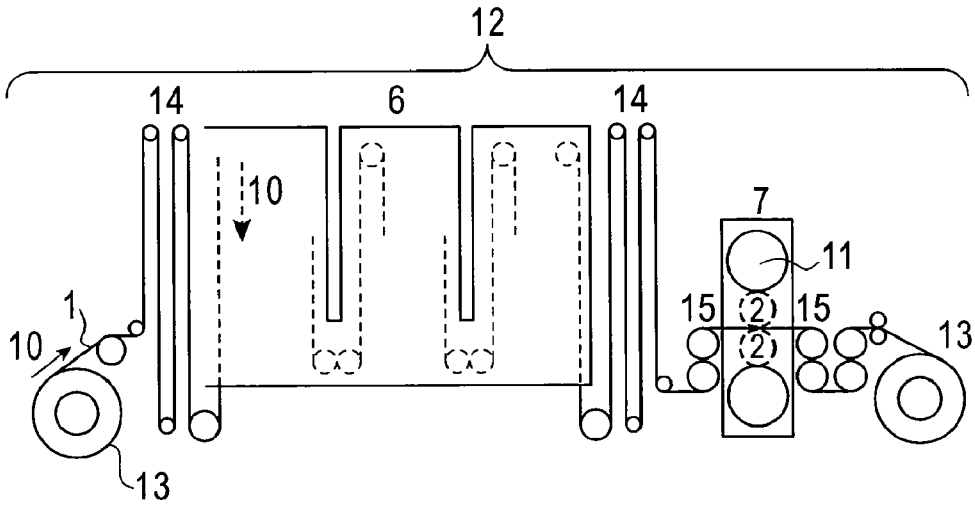
FIG. 4 is a schematic structural view showing one example of a temper rolling mill according to aspects of the present invention installed in a continuous annealing facility.

FIG. 4 shows one example of the temper rolling mill, according to an exemplary embodiment of the present invention, which is provided in a continuous annealing facility 12 (continuous annealing line). In a temper rolling mill 7 provided downstream of an outlet side of an annealing furnace 6, high roughness rolls 2 are provided, and after a steel sheet 1 is processed by continuous annealing, temper rolling is performed in this mill. In addition, in FIG. 4, although only one stand is shown as the roll stand in the temper rolling mill 7, at least two stands may also be provided, and a downstream-side stand may have bright rolls.

In addition, in FIG. 4, reference numeral 10 indicates a sheet traveling direction, reference numeral 11 indicates a back-up roll, reference numeral 13 indicates a coil for a steel strip, reference numeral 14 indicates a looper, and reference numeral 15 indicates a tension application device (bridle rolls). In addition, although not shown in the figure, a quenching device and a tempering device may be provided inside or downstream of the annealing furnace 6 (however, upstream of the temper rolling mill 7).

(Control of Surface Roughness of Steel Strip before Temper Rolling)

In the case of a high-tensile strength cold rolled steel sheet having a tensile strength of 980 MPa or more, which is manufactured by continuous annealing including a quenching treatment and a tempering treatment, the steel-sheet shape is liable to be degraded in many cases due to thermal strain generated during the quenching. Hence, when the predetermined elongation percentage described above is imparted by a temper rolling mill having high roughness rolls, and the predetermined average roughness described above is controlled, the degree of shape defect can be significantly improved. In addition, this effect is increased as the average roughness of a steel sheet surface before shape correction is decreased, that is, as the surface is smoother.

Figure 5:
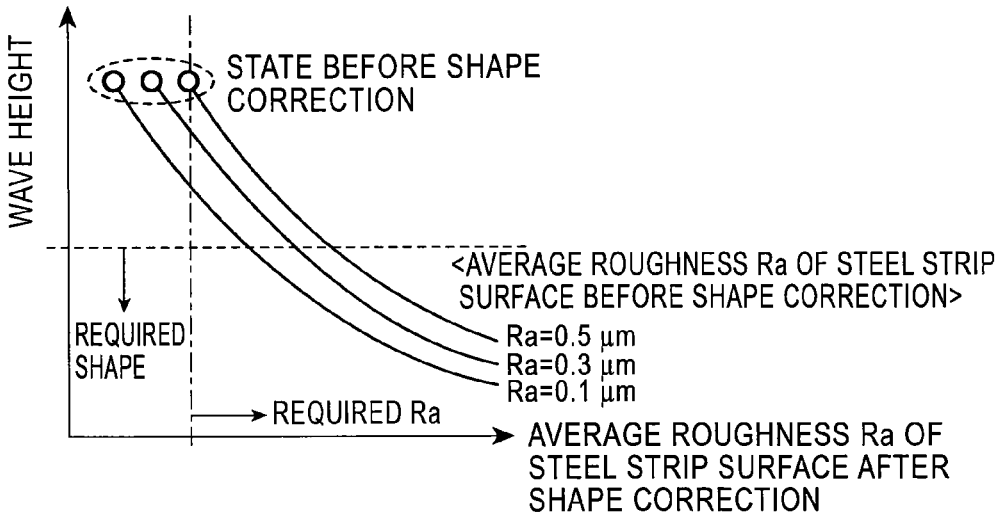
FIG. 5 is a view showing the relationship between a wave height (vertical axis) of a steel strip and the average roughness Ra (horizontal axis) of a steel strip surface after shape correction, the steel strip being each of steel strips which are obtained in such a way that, in a tandem cold rolling mill, cold rolled steel strips having steel strip-surface average roughnesses Ra of 0.1, 0.3, and 0.5 μm are processed by continuous annealing and are then shape-corrected by temper rolling.

FIG. 5 is a view showing the relationship between the wave height (vertical axis) of a steel strip and the average roughness Ra (horizontal axis) of a steel strip surface after shape correction, the steel strip being each of steel strips which are obtained in such a way that, in a tandem cold rolling mill, cold rolled steel strips having steel strip-surface average roughnesses Ra of 0.1, 0.3, and 0.5 μm are processed by continuous annealing and are then shape-corrected by temper rolling.

In this figure, the wave height of a steel strip is an index indicating the shape thereof and is the maximum height when a steel strip having a length of 1,500 mm is placed on a surface plate. Hence, a smaller wave height is better, and when the flatness of the shape of a steel strip is defined, the upper limit of the wave height is set in many cases.

From FIG. 5, as the average roughness Ra of a steel strip surface before shape correction is decreased, the average roughness of a steel strip surface after shape correction is decreased; hence, it is found that a transfer roughness required for shape correction may be decreased.

Figure 6:
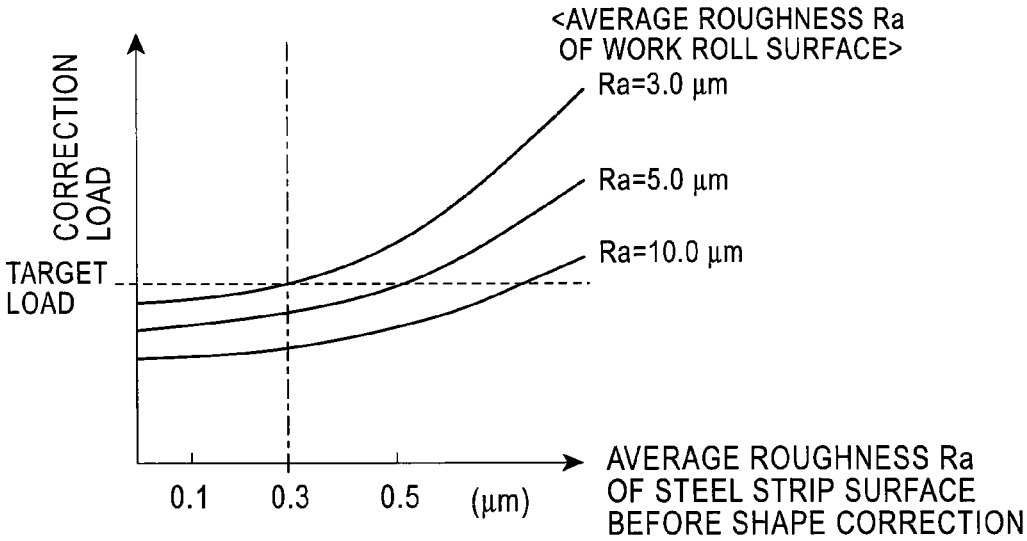
FIG. 6 is a view showing the relationship at each average roughness of a work roll surface between the correction load (temper rolling load) (vertical axis) and the average roughness Ra (horizontal axis; unit: μm) of a steel strip surface before shape correction, the correction load being a load at which the shape correction is performed to obtain a required steel sheet shape.

In addition, FIG. 6 is a view showing the relationship between the correction load (temper rolling load) (vertical axis) and the average roughness Ra (horizontal axis; unit: am) of a steel strip surface before shape correction, the correction load being a load at which a high tensile-strength cold rolled steel sheet having a tensile strength of 980 MPa or more is corrected to have a required steel sheet shape using high roughness rolls having surface average roughnesses of 3.0, 5.0, and 10.0 μm.

From FIG. 6, it is found that as the average roughness Ra of a steel strip surface before shape correction is decreased, the correction load decreases. In addition, in order to obtain a sufficient shape correction effect, it is found that the average roughness Ra of a steel strip surface before shape correction is preferably set to 0.3 μm or less. The average roughness before correction is more preferably set to 0.2 μm or less. Furthermore, it is found from FIG. 6 that when the average roughness of the surface of a high roughness work roll is set to 5.0 μm or more, the load decreasing effect is further enhanced.

In addition, although the results described above are obtained through investigation using steel sheets having a thickness of approximately 1.0 to 2.3 mm, a yield strength of approximately 700 to 1,300 MPa, and a wave height (before shape correction) of approximately 10 to 30 mm, the results obtained through investigation in which the sheet thickness, the yield strength, and the like are changed are approximately equivalent to those described above. In addition, even when rolling using the high roughness rolls is performed more than once, the relationships shown in FIGS. 5 and 6 are also obtained as in the case in which rolling is performed once.

As described above, in order to effectively improve the degree of shape defect generated during continuous annealing by subsequent temper rolling, the average roughness Ra of a steel strip surface before annealing is preferably set to 0.3 μm or less.

In the case described above, the average roughness of a steel strip surface before shape correction can be adjusted by cold rolling. At a final roll stand of a tandem cold rolling mill, rolls having various roughnesses are used in accordance with purposes, and for example, when work rolls (bright rolls) having a center-line averaged roughness Ra of 0.3 μm or less are used at the final roll stand, the average roughness Ra of a steel strip surface can be controlled to be 0.3 μm or less.

Figure 7:
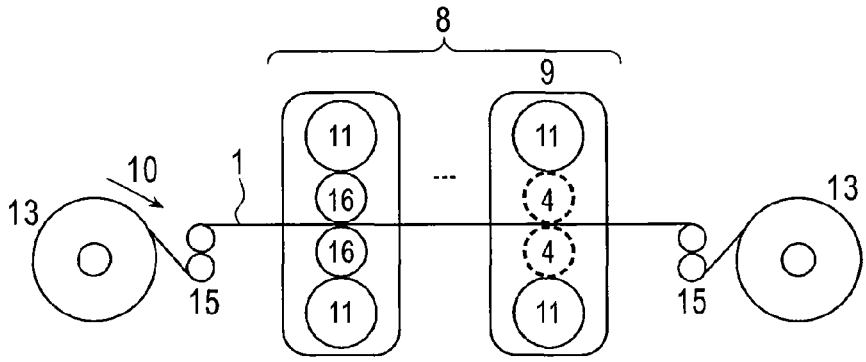
FIG. 7 is a schematic structural view showing one example of a tandem cold rolling mill according to aspects of the present invention.

In FIG. 7, one example of the tandem cold rolling mill according to an aspect of the present invention is shown. A tandem cold rolling mill 8 shown in FIG. 7 uses bright rolls 4 at a final stand 9 of roll stands. In this case, work rolls 16 for cold rolling other than those at the final stand are not particularly specified, bright rolls are generally used. In FIG. 7, reference numeral 10 indicates a sheet traveling direction, reference numeral 11 indicates a back-up roll, reference numeral 13 indicates a coil for a steel strip, and reference numeral 15 indicates a tension application device (bridle rolls). Although the tension application device 15 is shown by two bridle rolls for the sake of convenience, a tensile application ability of the tandem cold rolling mill is much larger than that of each of the tension application devices provided before and after the temper rolling mill shown in FIG. 4 by way of example.

In this figure, although the tandem cold rolling mill 8 is shown as a batch type mill, it is not limited thereto, and a continuous type mill may also be used. In addition, in FIGS. 4 and 7, although each roll stand is shown as a four-stage type stand by way of example, it is not limited thereto, and the advantage similar to that described above can also be obtained when a two-stage type, six-stage type, or a cluster type roll stand is used.

According to embodiments of the present invention described above, even to a steel strip made of hard steel, such as a high-carbon steel or a high tensile strength steel having a yield strength of 340 MPa or more, a predetermined elongation percentage, flatness, and center-line averaged roughness can be imparted to a steel strip at a rolling load approximately equivalent to that for mild steel without using a large facility and complicated control, and hence a cold rolled steel strip having a good shape and superior die galling resistance can be obtained.

In addition, since the stress generated during temper rolling can be suppressed by the load decreasing effect, and only local and required minimum plastic deformation is imparted, sliding between a work roll and a steel strip is small, and hence the decrease in center-line averaged roughness Ra of the work roll caused by wear can be suppressed. Hence, a sufficient roughness can be stably imparted to a steel strip, and frequent work roll exchange is not required.

In addition, in exemplary methods provided according to aspects of the present invention, it is not necessary to increase the rolling load/rolling tensile force, decrease the diameter of work rolls, and increase the sheet temperature, and a normal load of 5 to 10 kN/mm, a normal tensile force of 0 to 100 MPa, a normal roll diameter of 400 to 1,000 mm, and a normal sheet temperature of from room temperature to 100° C. may be used. However, it is not prohibited to additionally use improvement means.

Although the composition of a high tensile-strength cold rolled steel sheet is not particularly limited, since the steel sheet is steel, 0.20% or less of C, 4% or less of other alloys and impurities, and iron as the balance are included. A sheet thickness of 0.2 to 5.0 mm is generally used, and a thickness of 2.5 mm or less is particularly preferable.

EXAMPLES

Hereinafter, aspects of the present invention will be described with reference to the examples.

Example 1

Figure 8:
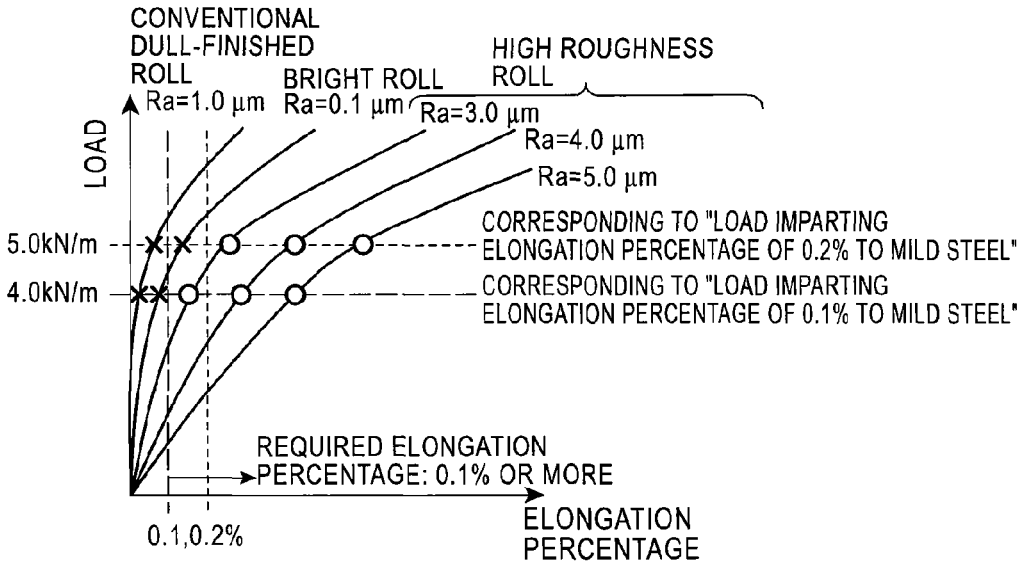
FIG. 8 is a view showing the relationships between the elongation percentage (horizontal axis) and the temper rolling load (vertical axis), which are obtained when temper rolling is performed on a workpiece having a thickness of 0.5 mm using dull-finished work rolls processed by a shot blasting method to have various center-line averaged roughnesses.

As a workpiece to be processed by temper rolling, a high tensile strength steel sheet having a thickness of 0.3 to 0.5 mm (before temper rolling), a center-line averaged roughness Ra of 0.3 to 0.5 μm, and a yield strength of 490 MPa was used. In FIG. 8, the relationship between the elongation percentage (horizontal axis, unit: %) and the load (vertical axis, unit: kN/mm) is shown which was obtained when temper rolling was performed on a workpiece having a thickness of 0.5 mm using dull-finished work rolls processed by a shot blasting method to have various center-line averaged roughnesses. In this example, Ra of the roll and that of the steel sheet surface were measured by a probe type two-dimensional roughness meter, and the elongation percentage was measured by the difference in velocity of transport rolls provided at an inlet side and an outlet side of a rolling mill.

A load corresponding to a temper rolling load at which an elongation percentage of 0.1% was imparted to common mild steel using general dull-finished work rolls (center-line averaged roughness Ra: 1.0 μm) was approximately 4.0 kN/mm. When a load of 4.0 kN/mm was applied to the workpiece of this example, as is obvious, a necessary elongation percentage of 0.1% could not be imparted by the general dull-finished work rolls. In addition, although bright rolls having an Ra of 0.1 μm were used, the load decreasing effect was insufficient, and hence an elongation percentage of 0.1% could not be imparted. On the other hand, when high roughness rolls (Ra: 3.0 μm or more) according to the example of the present invention were used, a sufficient elongation percentage could be imparted, and it was found that a significant transcription elongation effect was obtained.

Furthermore, in order to obtain a higher shape correction effect, a load of 5.0 kN/mm was applied which corresponded to a temper rolling load at which an elongation percentage of 0.2% was imparted to common mild steel using general dull-finished work rolls (center-line averaged roughness Ra: 1.0 μm), and temper rolling was performed using work rolls having various surface roughnesses. Also in this case, as in the case described above, a necessary elongation percentage of 0.2% could not be imparted by the general dull rolls and by the bright rolls; however, the above elongation percentage could be obtained by the high roughness rolls.

At the above two rolling loads, when the center-line averaged roughness of the high roughness roll was increased to 4.0 and 5.0 μm, a significant increase in elongation percentage (or a decrease in rolling load at a predetermined elongation percentage) was recognized.

Figure 9A:
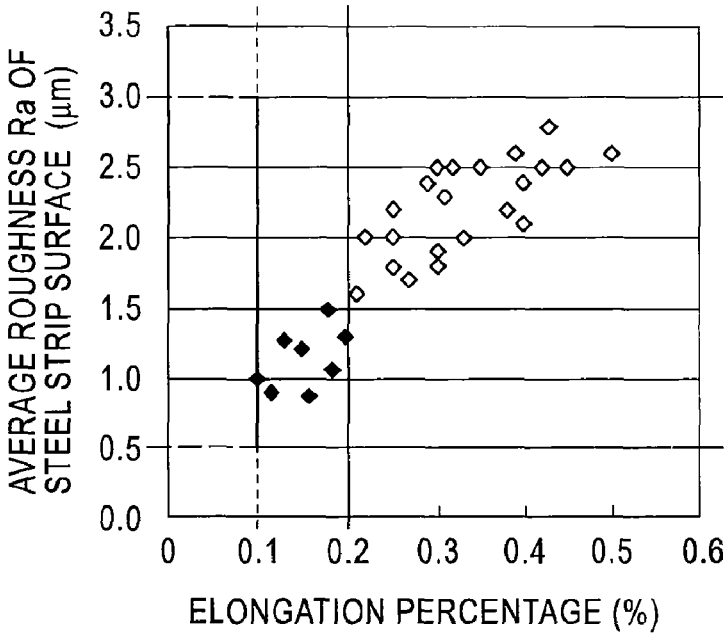
FIG. 9A is a view showing the relationship between the elongation percentage (horizontal axis, unit: %) and the average roughness (vertical axis, unit: μm) of a steel strip surface after temper rolling, which is obtained when temper rolling is performed using work rolls having a center-line averaged roughness Ra of 4.0 μm.
Figure 9B:
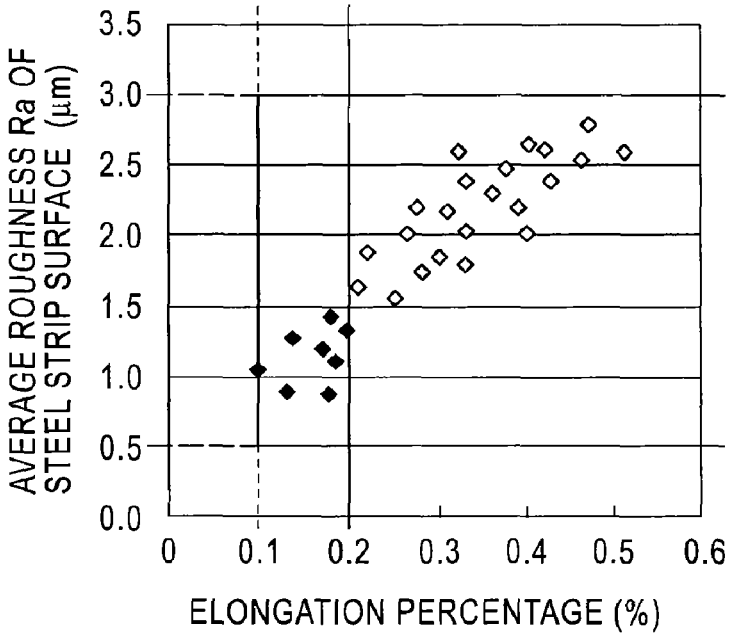
FIG. 9B is a view showing the relationship between an elongation percentage (horizontal axis, unit: %) and the average roughness (vertical axis, unit: μm) of a steel strip surface after temper rolling, which is obtained when temper rolling is performed using work rolls having a center-line averaged roughness Ra of 5.0 μm.

In addition, in FIG. 9A, the results obtained when temper rolling was performed using work rolls having a center-line averaged roughness Ra of 4.0 μm are shown, and in FIG. 9B, the results obtained when temper rolling was performed using work rolls having a center-line averaged roughness Ra of 5.0 μm are shown (horizontal axis: elongation percentage (%), vertical axis: center-line averaged roughness Ra (μm) of a steel strip surface after temper rolling). In both cases, at a load (4.0 kN/mm) corresponding to a temper rolling load for common mild steel, a targeted elongation percentage (0.1% or more) and a targeted center-line averaged roughness Ra (0.5 to 3.0 μm) could be imparted to all steel strips, and it was found that a cold rolled steel sheet made of hard steel having superior flatness and die galling resistance could be obtained.

In the examples shown in FIGS. 9A and 9B, when an elongation percentage of 0.2% or more was imparted, in both cases, the averaged roughness Ra of a steel strip surface after temper rolling was within the range of 1.5 to 3.0 μm, and the shape and the expected die galling resistance were further improved. In addition, when the results shown in FIGS. 9A and 9B were compared to each other, as for the relationship between the elongation percentage and the average roughness of a steel strip surface, approximately the same behavior was observed in the two cases. However, as described above, the transcription elongation effect became significant in particular when temper rolling was performed using the work rolls having a center-line averaged roughness Ra of more than 4.0 μm, and when the work rolls having a center-line averaged roughness Ra of 5.0 μm as shown in FIG. 8 were used, a load for imparting the same elongation percentage decreased.

Example 2

Figure 10:
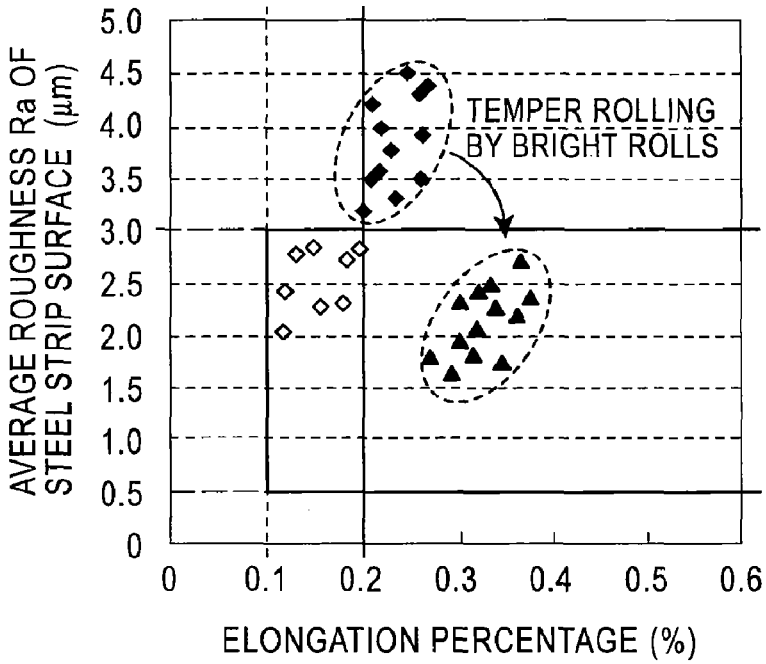
FIG. 10 is a view showing the relationships between the elongation percentage (horizontal axis, unit: %) and the average roughness (vertical axis, unit: μm) of a steel strip surface after temper rolling, which are obtained when temper rolling is performed on steel strips using dull-finished work rolls processed by an electrical discharge dull finishing method to have a center-line averaged roughness Ra of 10.0 μm, and when temper rolling is further performed on some of the above temper-rolled steel strips using bright rolls.

As a workpiece to be processed by temper rolling, a high-carbon steel sheet having a thickness of 2.0 to 3.0 mm (before temper rolling), a center-line averaged roughness Ra of 0.6 to 0.8 μm, and a yield strength of 690 MPa was prepared. In FIG. 10, the results obtained when temper rolling was performed on this high-carbon steel using dull-finished work rolls processed by an electrical discharge dull finishing method to have a center-line averaged roughness Ra of 10.0 μm are shown (horizontal axis: elongation percentage (%), vertical axis: center-line averaged roughness Ra (μm) of a steel strip surface after temper rolling).

When an elongation percentage of 0.1% to 0.2% was imparted (outline diamond shape), a center-line averaged roughness of 3 μm or less was simultaneously satisfied; however, when an elongation percentage of 0.2% or more was imparted (black diamond shape), the center-line averaged roughness was more than a targeted roughness range (upper limit Ra: 3.0 μm). As described above, since an elongation percentage of 0.2% or more is preferably imparted to a shape-strict material, the exceeded roughness is preferably adjusted.

Accordingly, temper rolling was performed by a temper rolling mill in which one roll stand having bright rolls was disposed downstream of a roll stand having the above dull-finished (high roughness) work rolls. In this case, the rolling conditions by the high roughness rolls were not changed, and as the rolling conditions by the bright rolls, the load was set to 5.0 kN/mm.

The results are also shown in FIG. 10, and since all the steel strips shown by the black diamond shapes had elongation percentages and center-line averaged roughnesses shown by black triangle shapes after the rolling by the bright rolls, it was confirmed that a targeted elongation percentage (0.2% or more: total obtained by the high roughness rolls and the bright rolls) and a targeted center-line averaged roughness (0.5 to 3.0 μm) could be imparted.

Example 3

Bright-finished work rolls having a center-line averaged roughness Ra of 0.05 μm were used at a final stand of a tandem cold rolling mill, and a steel strip having a center-line averaged roughness Ra of 0.2 μm and a sheet thickness of 1.5 mm after cold rolling was prepared as a workpiece.

After cold rolling, this workpiece was processed by annealing, a water quenching treatment, and a tempering treatment (in an annealing furnace) in a continuous annealing facility, and a final tensile strength and yield strength were 1,300 and 1,000 MPa, respectively. In addition, since the workpiece was deformed, during the water quenching treatment, by thermal stress generated by rapid temperature change and expansion caused by martensite transformation, after the quenching treatment, the wave height was increased to 20 mm and was outside the required shape.

This workpiece was processed by temper rolling at various rolling loads in a temper rolling mill provided at an annealing furnace outlet side of a continuous annealing furnace using work rolls which were processed by an electrical discharge dull finishing method to have a center-line averaged roughness Ra of 4.0 μm and that of 10.0 μm, followed by hard chromium plating.

Figure 11:
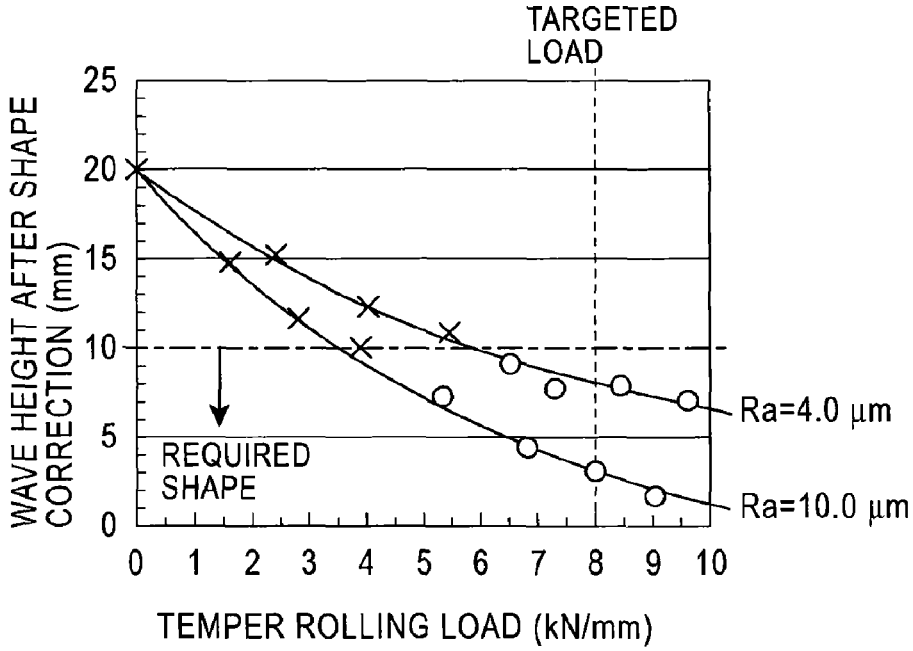
FIG. 11 is a view showing the relationship at each average roughness of a work roll surface between the temper rolling load (horizontal axis, unit: kN/mm) and the wave height after shape correction, the temper rolling load being a load when temper rolling is performed on a workpiece having a wave height (mm) of 20 mm.

FIG. 11 is a view showing the relationship between the temper rolling load (horizontal axis, unit: kN/mm) at which the workpiece was processed by temper rolling and the wave height (vertical axis, mm) after shape correction. Concomitant with an increase of the temper rolling load, the shape correction effect was improved, and the required shape could be achieved by the above two types of rolls.

In the example shown in FIG. 11, under the conditions in which a desired shape shown by ○ (outline circle) was satisfied, an elongation percentage of 0.1% to 0.2% was imparted, and the center-line averaged roughness Ra of a steel sheet in this case was 1.5 to 2.8 μm, so that the targeted elongation percentage and surface roughness were obtained.

In addition, even when the number of rolling steps (number of stands) using the high roughness rolls is set to more than once, the results equivalent to those described in Examples 1 to 3 can be obtained without causing any problems. When rolling using the bright rolls is performed more than once, results equivalent to those shown in FIG. 10 can be obtained in accordance with the total elongation percentage.

From the above Examples 1 to 3, it was found that when embodiments of the method of the present invention are used, even to a steel strip made of hard steel, such as high-carbon steel, high tensile-strength steel having a yield strength of 340 MPa or more, or high tensile-strength steel manufactured by continuous annealing including a quenching treatment and a tempering treatment and having a tensile strength of 980 MPa or more, a predetermined elongation percentage, flatness, and center-line averaged roughness can be imparted to a steel strip by applying a rolling load approximately equivalent to that for a mild steel without using a large facility and complicated control. Accordingly, by using an existing temper rolling mill, a predetermined flatness and surface roughness can be imparted to a steel strip. In addition, manufacturing of a steel strip made of hard steel having superior flatness and die galling resistance can be realized, and significant industrial advantages can be obtained.

That is, without changing and modifying an existing facility, manufacturing of a high tensile-strength cold rolled steel sheet that satisfies the targeted shape can be realized only by changing the average roughness Ra of a work roll surface. As a result, since an additional shape-correction step is not required, cost can be reduced, and a delivery time can be shortened.

In addition, in a conventional temper rolling step, when shape correction cannot be sufficiently performed, various troubles can occur in a step of winding a steel strip around a coil which is performed after temper rolling. However, according to the present invention, since winding can be performed after shape correction is performed, sheet traveling problems during winding can be overcome, and scratches generated between steel strips caused by meandering can be eliminated.

The invention claimed is:

1. A method for performing temper rolling on a steel strip comprising:

performing temper rolling with a temper rolling mill at an elongation percentage of 0.1% or more on a steel strip having a yield strength of 340 MPa or more, wherein the temper rolling mill includes at least one roll stand having work rolls, the center-line averaged roughness Ra of the work rolls being in the range of 3.0 to 10.0 μm.

2. The method for performing temper rolling on a steel strip according to claim 1, wherein performing the temper rolling produces an average roughness Ra of a steel strip surface that is in the range of 0.5 to 3.0 μm after the temper rolling.

3. The method for performing temper rolling on a steel strip according to claim 1, wherein the temper rolling mill is downstream of an outlet side of an annealing furnace of a continuous annealing facility and is one constituent of the continuous annealing facility, and the steel strip is a high tensile-strength cold rolled steel strip having a tensile strength of 980 MPa or more that has been manufactured by a continuous annealing process that includes a quenching treatment and a tempering treatment.

4. The method for performing temper rolling on a steel strip according to claim 3, wherein comprising performing cold rolling so that the average roughness Ra of a steel strip surface is controlled to be 0.3 μm or less.

5. The method for performing temper rolling on a steel strip according to claim 3, comprising performing the temper rolling at an elongation percentage of 0.2% or more.

6. The method for performing temper rolling on a steel strip according to claim 4, comprising performing the temper rolling at an elongation percentage of 0.2% or more.

7. A method for manufacturing a high tensile-strength cold rolled steel strip comprising the method of claim 1.

8. A method for manufacturing a high tensile-strength cold rolled steel strip comprising the method of claim 3.

9. A method for manufacturing a high tensile-strength cold rolled steel strip comprising the method of claim 4.

10. A method for manufacturing a high tensile-strength cold rolled steel strip comprising the method of claim 5.

11. A method for manufacturing a high tensile-strength cold rolled steel strip comprising the method of claim 6.

12. The method for performing temper rolling on a steel strip according to claim 1, comprising performing the temper rolling at an elongation percentage of 0.2% or more.

13. A method for manufacturing a high tensile-strength cold rolled steel strip comprising the method of claim 12.

14. A method for performing temper rolling on a steel strip comprising:

performing temper rolling with a temper rolling mill at an elongation percentage of 0.1% or more on a steel strip having a yield strength of 340 MPa or more, wherein the temper rolling mill includes (i) at least one first roll stand having work rolls, the center-line averaged roughness Ra of the work rolls being in the range of 3.0 to 10.0 μm; and (ii) at least one second roll stand downstream of the first roll stand, wherein the at least one second roll stand has bright-finished work rolls.

15. The method for performing temper rolling on a steel strip according to claim 14, wherein performing the temper rolling produces an average roughness Ra of a steel strip surface that is in the range of 0.5 to 3.0 μm after the temper rolling.

16. The method for performing temper rolling on a steel strip according to claim 14, comprising imparting a total elongation percentage of 0.1% or more on the steel strip by the first roll stand, and performing the temper rolling by the second roll stand to produce an average roughness Ra of a steel strip surface that is in the range of 0.5 to 3.0 μm.

* * * * *